US006904974B2

(12) United States Patent
Slack

(10) Patent No.: US 6,904,974 B2
(45) Date of Patent: Jun. 14, 2005

(54) SLOTTING GEOMETRY FOR METAL PIPE AND METHOD OF USE OF THE SAME

(75) Inventor: Maurice William Slack, Edmonton (CA)

(73) Assignee: Noetic Engineering Inc., Edmonton (CA)

( * ) Notice: Subject to any disclaimer, the term of this patent is extended or adjusted under 35 U.S.C. 154(b) by 74 days.

(21) Appl. No.: 10/260,156

(22) Filed: Sep. 27, 2002

(65) Prior Publication Data

US 2003/0062170 A1 Apr. 3, 2003

(30) Foreign Application Priority Data

Sep. 28, 2001 (CA) ..... 2357883

(51) Int. Cl.[7] ..... E21B 43/10
(52) U.S. Cl. ..... 166/384; 166/233; 166/207
(58) Field of Search ..... 166/233, 227, 166/207, 377, 378, 284, 381; 210/498, 497.1

(56) References Cited

U.S. PATENT DOCUMENTS 1,620,412 A 3/1927 Tweedale
4,343,359 A 8/1982 Krause ..... 166/233
5,366,012 A * 11/1994 Lohbeck ..... 166/277
6,315,040 B1 * 11/2001 Donnelly ..... 166/207
6,354,373 B1 * 3/2002 Vercaemer et al. ..... 166/277
6,382,318 B1 * 5/2002 Whitlock ..... 166/278
6,523,611 B1 * 2/2003 Bakker et al. ..... 166/298
2003/0079886 A1 * 5/2003 Schetky et al. ..... 166/382

* cited by examiner

*Primary Examiner*—David Bagnell
*Assistant Examiner*—Daniel P Stephenson

(57) ABSTRACT

A slotting geometry for a metal pipe for use in fabricating slotted liners. The slotting geometry includes one or more integral substantially continuous unslotted helical coils extending around a peripheral sidewall for sustantially the entire length of a tubular body. There are helical regions between the coils containing slots arranged to create generally trapezoidally shaped elongated struts joining the edges of adjacent coils. Ends of the tubular body have unslotted connecting portions, thereby facilitating connection with the tubular body. Slotted liners fabricated using this slotting geometry have the capability of having their outer diameter expanded or contracted. This has utility when inserting or removing the slotted liners iinto a well bore. By expanding or contracting the outer diameter, the slots can be made to be sider or narrower, this has utility in controlling slot width.

37 Claims, 6 Drawing Sheets

SLOTTING GEOMETRY FOR METAL PIPE AND METHOD OF USE OF THE SAME

FIELD OF THE INVENTION

The present invention relates to a slotting geometry for metal pipe and a method of use of the same to line bore holes in porous earth formations to exclude entry of solid particles while permitting fluid flow.

BACKGROUND OF THE INVENTION

Metal pipe having through-wall slots, referred to as "slotted liners", are commonly used to line bore holes in porous earth formations to exclude entry of solid particles while permitting fluid flow through the liner wall. As is well known in the art, the selection of slotting geometry affects the structural capacity of the slotted liner in addition to its filtering characteristics. The selection of slot geometry thus typically considers the impact of slotting on the usual structural properties of axial, torsion and collapse load capacities. U.S. Pat. No. 1,620,412 (Tweeddale 1927) is an example of an early patent in which the importance of slot geometry was recognized.

SUMMARY OF THE INVENTION

The present invention relates to a slotting geometry for metal pipe, which provides a slotted liner with some unique properties.

According to a first aspect of the present invention there is provided a slotting geometry for a metal pipe having a tubular body having a first end, a second end, and a peripheral sidewall having slots arranged in a geometric pattern. The slots extend through the peripheral sidewall thereby permitting fluid communication from an exterior surface of the tubular body to an interior of the tubular body. The slotting geometry includes at least one integral substantially continuous unslotted helical coil extending around the peripheral sidewall for substantially the entire length of the tubular body. The slots are further arranged to leave the material attaching adjacent coils dimensioned to act as elongate struts. Individual struts are generally parallelogram shaped in the plane defined by the surface of the metal pipe, preferably having a length greater than twice their width. Under application of deforming loads the elongate struts thus dimensioned tend to pivot or hinge in their end region of attachment to the coils, and act to maintain the coil spacing in the direction of the strut constant. Both the first end and the second end of the tubular body have unslotted connecting portions, thereby facilitating connection with the tubular body.

According to another aspect of the present invention there is provided a slotted liner having the slotting geometry described above.

When the above described slotting geometry was developed, problems were being encountered in removing slotted liners from well bores. The slotted liners were being substantially restrained or gripped by contact with surrounding solid or packed materials. The slotting geometry and slotted liner described above was developed based upon two general principles: a left hand helix tends to decrease in diameter under the application of a right hand twist when kept at constant length; and a helix tends to expand when compressed in the absence of twist. Considering these geometric effects, it was realized that providing longitudinally oriented struts joining helical coils would ensure dominance of the first principle, namely right hand twist will cause a diameter reduction. When a length of such slotted liner is employed in a well bore having its upper end structurally connected to a tubular work string preparatory to attempting removal, this property supports removal of the liner by enabling the liner to be retracted from the confining material upon application of sufficient right hand torque at surface and transmitted through the work string to impose twist in the liner, beginning at its upper end and propagating downward. As retraction thus progresses downward, radial contact stress supporting frictional engagement with the bore hole, that would otherwise prevent removal and indeed rotation causing the twist, is eliminated or substantially reduced along the retracted liner length allowing the liner to be pulled out of the bore hole with greatly reduced drag. Retraction under application of right hand torque is preferred over left hand torque only because said work strings, typically used by industry, are joined by threaded connections that tend to unscrew under application of left hand torque. It is particularly advantageous that such a slotted liner can be provided without significant reduction of the structural capacity typically provided by existing slotted liner architectures and can use slots which are longitudinally oriented to take advantage of existing slotting equipment configured to only place longitudinal slots through the wall of metal pipe.

Once the method was developed it was realised that the inverse of this principle is also true, a left hand helix tends to increase in diameter under the application of a left hand twist. When the helix is part of a slotted liner, the slot width of longitudinal slots will tend to either increase or decrease depending upon whether the helix is being expanded or contracted. This provided a means to change the slot width of the slotted liner, by application of sufficient torsion or axial load either separately or in combination.

It was further realized that placing the slots at angles other than longitudinal, enabled the twist to be generated by application of axial load, allowing helically slotted structures that may for example be expanded or contracted by application of axial compression. Parameters defining the helical slotting pattern, according to the method of the present invention, thus allow broad control of the relationship between slot width and diameter change and the loads required to induce these changes.

DESCRIPTION OF THE PREFERRED EMBODIMENT

Figure 1:
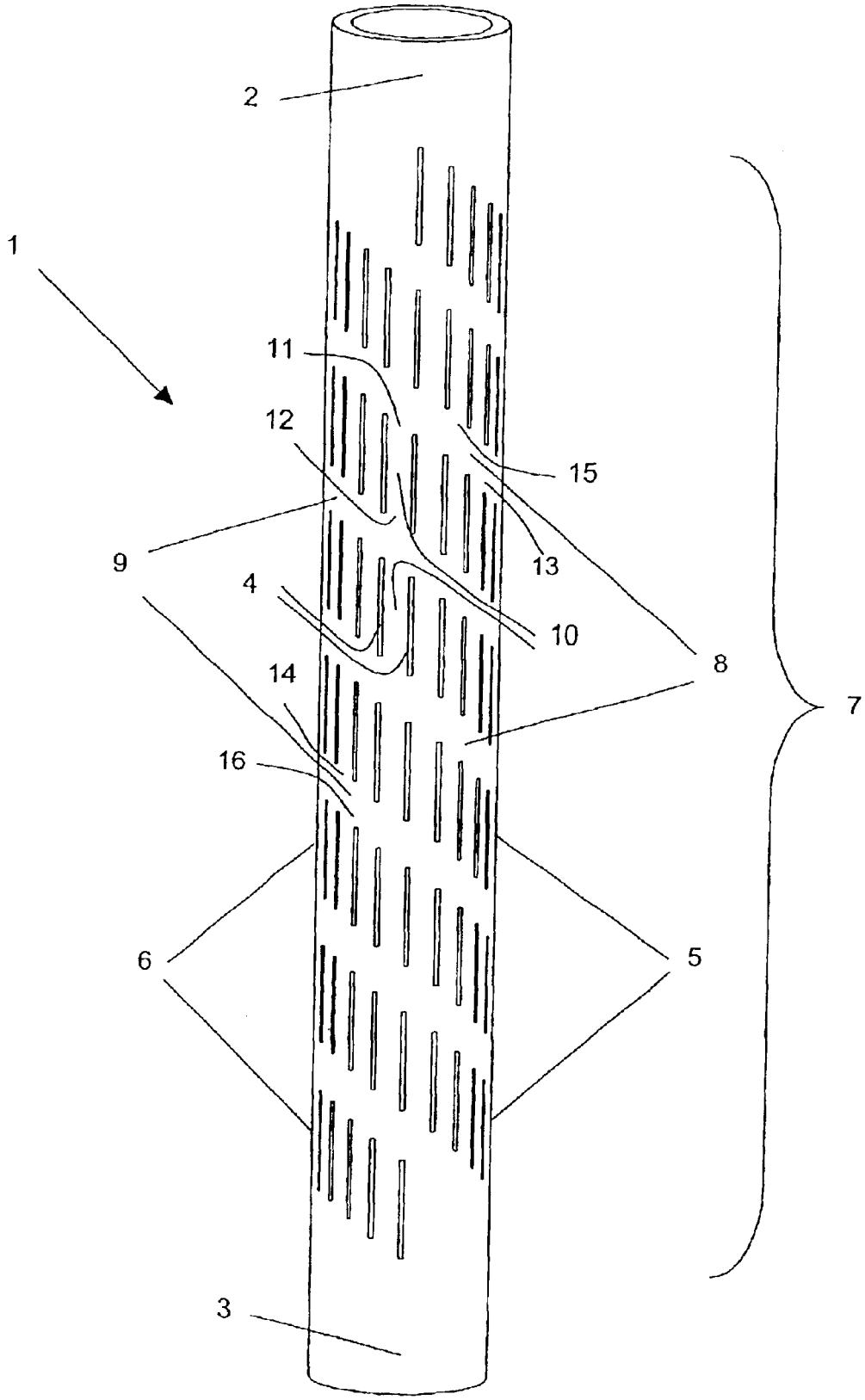
FIG. 1 is a side elevation view of a slotted liner fabricated according to the teachings of the present invention with longitudinal slots.

There will first be described a slotted liner, generally indicated by reference numeral 1, having a slotting geometry in accordance with the teachings of the present invention. There will then be, described unique methods of using the slotted liner in field applications, with reference to FIGS. 1 through 6.

According to the preferred embodiment of the present invention, the method of placing slots through the wall of a metal pipe in a helical pattern is implemented to produce a helically slotted tubular article having longitudinal slots disposed along two helical paths suitable for use as a retractable slotted liner. Referring now to FIG. 1, the helically slotted tubular article is comprised of a metal pipe 1, suitable for use as a slotted liner, having an upper end 2 and lower end 3. Longitudinal slots 4 extending through the wall of the metal pipe 1 and of approximately constant length are disposed at regular circumferential intervals along left hand helical paths 5 and 6. Helical paths 5 & 6 have approximately constant pitch, are positioned at opposing circumferential positions, and extend over the same slotted interval 7 of the pipe body leaving both the upper and lower ends 2 & 3 of the metal pipe 1 as unslotted end intervals. Unslotted upper and lower ends 2 & 3 are typically configured as threaded connections to facilitate joining lengths of such helically slotted liner to each other or other elements of an installation or completion string.

The length of the slots 4 are chosen to be less than the pitch of the individual helical paths 5 and 6 to leave unslotted helical intervals forming two helical coils 8 & 9 through the helically slotted interval 7. The circumferential regions between the slots 4 thus effectively form longitudinal struts 10 having upper and lower ends 11 & 12 respectively. The circumferential spacing of the slots 4 will be seen to control the width of the struts 10, which width is preferably arranged to provide struts 10 having a length to width ratio of at least two (2). It will be seen in FIG. 1 that struts along helical path 5 are generally attached at their upper ends 11 to the lower edge 13 of coil 8 and at their lower ends 12 to the upper edge 14 of coil 9. Struts along helical path 6 are similarly attached to the upper and lower edges 15 & 16 of helical coils 8 & 9 respectively.

Figure 2:
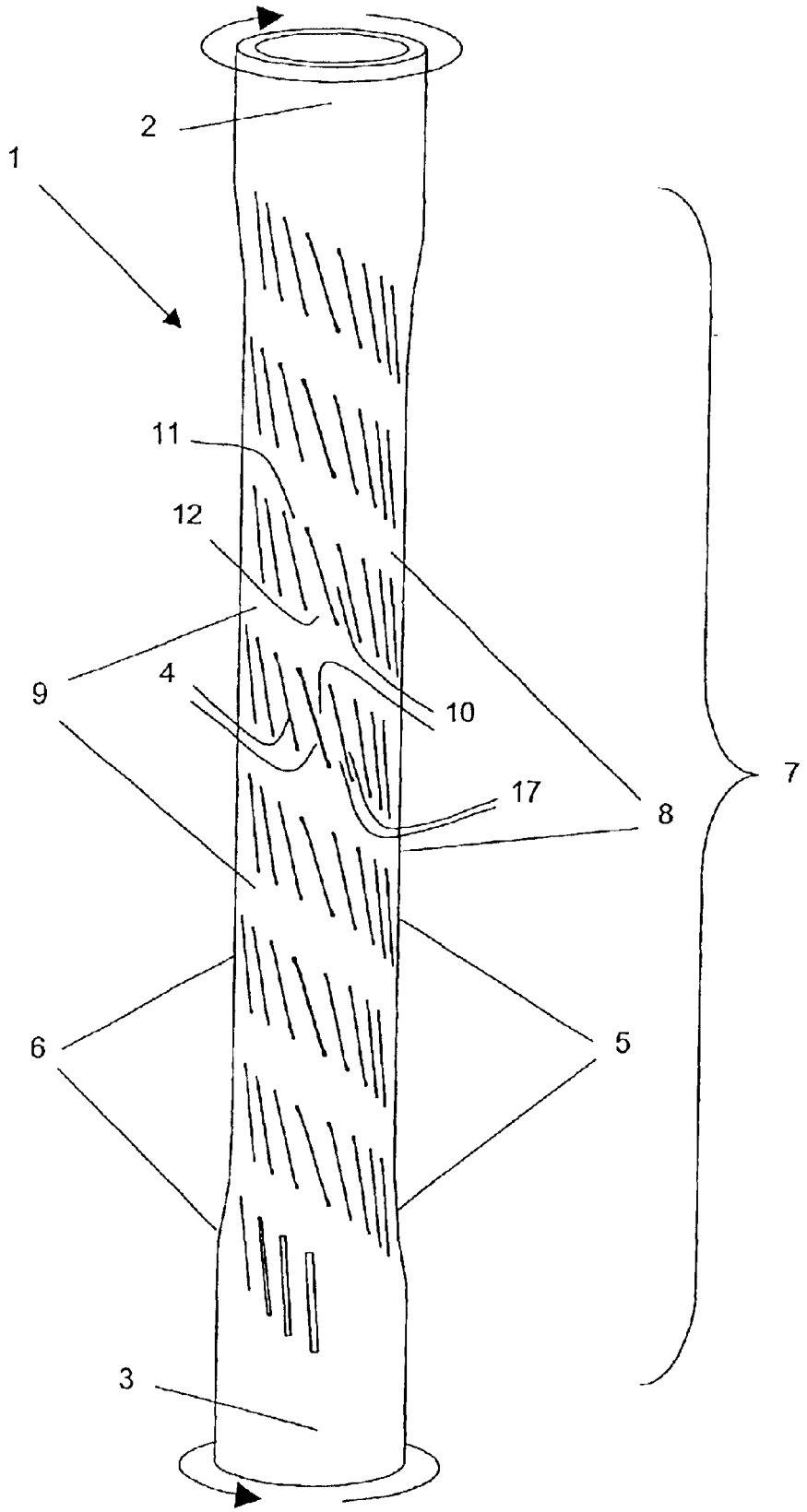
FIG. 2 is a side elevation view of the slotted liner illustrated in FIG. 1, to which a torsional load has been applied causing twist sufficient to close slots and reduce diameter in accordance with the teachings of the present invention. (deformations shown exaggerated).

Referring now to FIG. 2, when the helically slotted tubular article thus provided is subjected to right hand torsional load, shown by the arrows at upper and lower ends 2 & 3, shear transferred along the struts 10 tends to be reacted as a moment at the upper and lower strut ends 11 & 12. If sufficient torque is applied, this moment induces a plastic hinge to form at the upper and lower strut ends 11 & 12 allowing substantial rotation of the struts 10 that simultaneously tends to close the slots 4. This rotation in turn allows the helically slotted interval 7 to twist with only modest reduction in axial length and thereby tightens the helical coils 8 & 9, which reduces their diameter. Combined with the tendency of the slots 4 to close, the overall diameter of the helically slotted interval 7 thus retracts as illustrated in FIG. 2.

Application of torque beyond that required close the slots, tends to force the edges 17 of adjacent struts 10 together reacting tension developed in the coils 8 & 9. This tension in the coils 8 & 9 combined with the normal and friction forces induced by contact along the strut edges 17 tends to resist further twist and provides a substantial increase in failure torque above that required to just close the slots.

Utility—Relating to Ease of Removal of Slotted Liner

The present invention was specifically conceived as a means to support removal of cemented or 'sanded-in' slotted liners located inside the well bores of petroleum wells. Removal of the liner may be motivated by a variety of recompletion objectives such as plugging of the slots, incremental drilling, chemical treatment, reperforating, etc. Slotted liners may be deployed to restrain solids inflow by placement directly in the open hole wellbore or inside wellbores already supported by perforated casing. Over time, the borehole material tends to slough in against the slotted liner in open hole completions. Similarly, where the slotted liner is placed inside cased hole, solids restrained by the liner accumulate in the annulus between the perforated casing and slotted liner exterior during production of fluids tending to form a solids pack. Attempts to remove such packed-in or 'sanded in' liners by application of axial load tends to meet with resistance from the confining solids pack, in many cases exceeding the axial load capacity of the liner and thus preventing removal.

Slot geometries are sought to maintain adequate levels for these capacities to support installation and in-situ loads without undue change in slot gap size as the primary variable controlling filtration behaviour.

Given this design approach, slot geometries offering maximum axial load capacity are chosen to support removal requirements. The slotting pattern most commonly employed to provide high axial load capacity and significant collapse and torque capacity places short longitudinally oriented slots through the wall of a tubular in circumferentially evenly spaced groups at axially spaced intervals, where the axial spacing is greater than the slot length. This slotting pattern creates, from the original tube, a structure that is a series of rings separated by integrally attached struts.

In addition, measures may be taken to reduce drag force. Connections between lengths of slotted liner are chosen to be external flush, and the exterior of the liner may be coated to reduce the friction coefficient existing at the solids pack liner interface. While these methods known to the art are helpful in reducing the drag developed per unit length, even modest lengths of liner commonly installed in vertical wells often still develop sufficient drag to prevent removal. Removal of liner from the long intervals of horizontal well bores is even more difficult.

For example technological advances in directional drilling within the oil industry have enabled wells to be completed with long horizontal sections in contact with the reservoir. Such long horizontal well bores, often in excess of 1,000 m, permit fluids to be injected into or produced from a much greater portion of the reservoir, than would be possible from a vertical well, with commensurately greater recovery of petroleum from a single well.

Where such reservoirs are comprised of weak rock such as unconsolidated sandstone, the horizontal section may be completed with slotted liners to prevent closure of the bore hole through collapse or sloughing of the reservoir material. Even modest radial stress developed from sand collapsed against the installed liner develops sufficient drag to prevent removal of conventionally designed slotted liners from such long wells. However the relatively high cost of drilling such wells makes the availability of remedial recompletion measures such as the removal of under performing slotted liner even more valuable.

The method of the present invention is directed to providing such helically slotted metal pipe where the slots, extend through the pipe wall providing fluid communication when in service, are preferably of approximately equal length, preferably have uniform width along their length but may be 'keystone' shaped or have parallel walls through their thickness, are arranged to lie on one or more helical paths extending over an interval of the pipe greater than at least one pitch of said helical path, said interval preferably leaving at least some portion of both the pipe ends unslotted to facilitate connection between slotted pipe joints, and are approximately evenly spaced circumferentially along a given helical path where the material between slots are referred to as struts.

Said helical paths are, preferably left hand helixes of similar pitch, approximately evenly spaced circumferentially, and extending over approximately the same interval of pipe.

The slot length is selected to be less than the spacing between adjoining helix paths, thus providing a tubular article having struts disposed along one or more coaxial helical paths separated by and attached to the edges of one or more unslotted generally continuous coaxial helical coils, said slotted paths and coils having their upper and lower ends co-terminating in respective upper and lower unslotted pipe ends of similar diameter. The slot length and circumferential spacing is arranged so that said struts have a length generally greater than their width, and preferably at least two times greater.

Consistent with the primary purpose of the present invention, it was recognised that application of sufficient right hand torque to such a left hand helically slotted pipe, having longitudinally aligned slots forming longitudinally aligned struts, will tend to induce said initially longitudinally aligned struts to rotate counter-clockwise about their centres by hinging at their ends in their region of attachment to the edges of the continuous helical coils. This rotation allows the pipe to twist, the slots to close and the diameter of the attached helical coil or coils to simultaneously reduce, thus providing an overall reduction in slotted pipe diameter. Where slots placed along the helical path are longitudinally aligned, the magnitude of diameter reduction obtained when the helically slotted pipe is twisted an amount sufficient to close the slots is approximately equal to the open area ratio of the slotted pipe, as typically used to characterize slotted liner, i.e., ratio of sum of pipe surface area intersected by slots to total pipe surface area over slotted interval. It will be apparent to one skilled in the art, that for typical open area magnitudes in the range of a few percent, this provides practically useful diameter reductions with respect to the stiffness of the confining material in most if not all well bore completion applications. It will also be apparent to one skilled in the art that the material properties must be matched to the desired amount of deformation to avoid fracture, particularly in the region at the ends of the struts where hinges form. However, the ductility typically available from steels used to form slotted liners provides a useful range of strut rotation.

By comparison of this helically slotted structure to that of the commonly used conventional slotting pattern, providing rings attached by circumferential rows of struts, it was further recognized that for similar slot densities and strut dimensions, the helical coil or coils of the present invention provide collapse resistance in a manner similar to the rings of the conventional architecture. Moreover, the longitudinally aligned helical struts provide very similar elastic torque and axial load capacities. Together these properties meet the additional advantages sought with respect to the existing practice for slotted liner design: little change in structural capacity and ready adaptability to existing longitudinal slotting equipment.

The practical utility of such helically slotted pipe is improved if the closure torque, i.e., the torque at which diameter reduction causing slot closure occurs, is less than the capacity of the connections typically available in industry to join lengths of slotted liner. It will be evident to one skilled in the art that the loss of shear strength at the free edges of longitudinal slots through the pipe wall tends to generally reduce the torsional stiffness and yield torque. Therefore through appropriate selection of material and slot and helix dimensions, helically slotted pipe designs having closure torques well below that of the unslotted tube body can be readily obtained.

The axial and torsional loads applied to retrieve slotted liners from downhole, must be manipulated from surface through a work string. Therefore precise control of downhole torque (torque at the liner) is difficult. In addition, as the twist propagates downward, any remaining drag will require greater torque at the liner top to continue the downward propagation of twist. It is therefore advantageous if the helically slotted liner torque capacity, i.e., torque causing structural failure, is significantly greater than the closure torque to thus provide a large 'safety margin' and improve the chance of loosening restrained slotted liner to greater depths.

As described above with reference to FIG. 2, it was found that for helically slotted pipes made according to the method of the present invention, application of torque greater than the closure torque tends to be carried through tension developed along the helical coils creating a compressive hoop reaction stress along the contacting slot edges. Through appropriate selection of helical coil dimensions, this behaviour readily supports designs having the desirable characteristic of torque capacity significantly greater than the closure torque. The present invention provides a helically slotted tubular article having a failure torque capacity in the same direction and of significantly greater magnitude than the torque required to induce diameter reduction.

Variation of Preferred Embodiment Supporting: Utility—Relating to Ease of Removal of Slotted Liner While the body of slotted liner joints may be helically slotted to enable reduction of diameter upon application of torque causing twist according to the teachings of the present invention, the un-slotted intervals between joints of slotted liner required for connections remain largely unchanged. The drag from these intervals will therefore not be reduced to the same degree as occurs where the diameter is reduced. It is therefore desirable to find means to reduce the drag occurring in this interval is short in length and preferably of a diameter less than the initial un-retracted pipe diameter.

Figure 3:
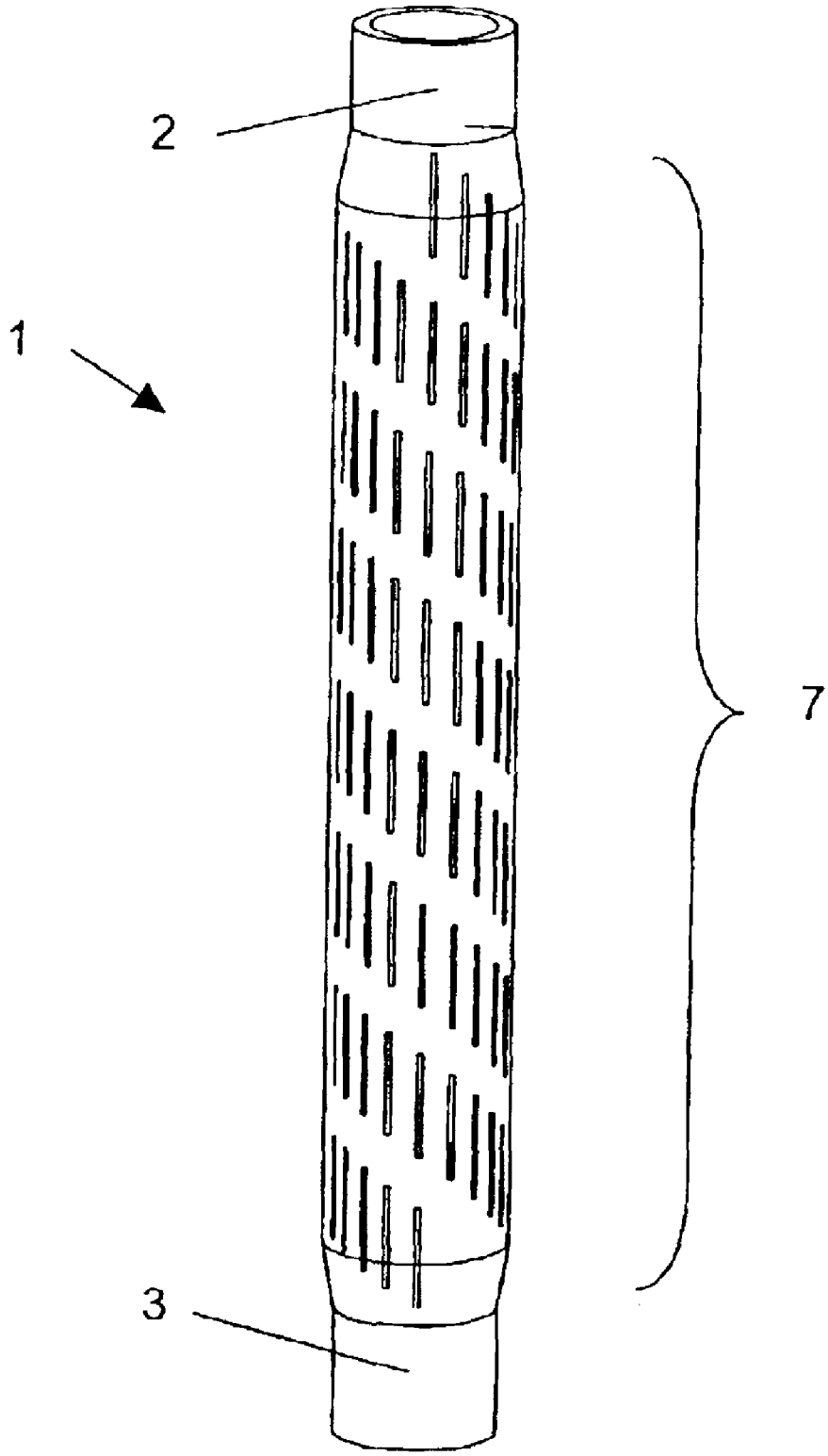
FIG. 3 is a side elevation view of the slotted liner illustrated in FIG. 1, where the unslotted ends are provided with reduced diameter.

Referring now to FIG. 3, this further purpose is realized by providing the pipe ends 2 and 3 of the helically slotted tubular article, and any additional connection components such as a threaded coupling, with outside diameter reduced from that of the un-retracted helically slotted tubular interval 7, and preferably equal to the retracted outside diameter. Once axial movement is initiated during retrieval of packed in slotted liner, the reduced diameter will tend to enter hole intervals where the solids pack had been retained at a slightly larger diameter and thereby offer less resistance to movement.

Utility—Relating to Surface and In Situ Changes of Slot Width:

The load-deformation mechanism provided by helically slotted tubular articles provides utility beyond diameter reduction to facilitate slotted liner retrieval. This mechanism, by which loads can be arranged to cause rotation of longitudinally aligned struts connecting the edges of adjacent coils in helically slotted pipe, can be used to increase or decrease both the diameter and slot size. The interaction of the various geometry variables provided by the helically slotted pipe architecture provides for a large degree of flexibility in these load vs deformation relationships. As already pointed out, the material properties of the pipe must also be considered to obtain the desired amount of deformation without fracture, particularly in the region at the ends of the struts where hinges form.

One application where variation of slot width is valuable occurs where very small slot widths are required to filter out finer grained material. To obtain these small slot widths, typically less than 0.010", it is advantageous if the slots can be cut with wider more robust saw blades and subsequently reduced in width. As already described, right hand twist applied to left hand helically slotted pipe with longitudinally aligned slots reduces the gap size. Where the slot and helix geometries are arranged so that twist produces plastic deformation at the strut ends where hinges tend to form, the method of the present invention may thus be used to permanently adjust the width of slots by application of torsion, perhaps in combination with axial load, following placement of the slots in the pipe wall. This adjustment may be carried out at surface or indeed downhole, supported by appropriate fixturing. Downhole or in-situ adjustment of the slot width need not be restricted to permanent changes since load may be retained by use of appropriate fixturing reacted into the borehole. The present invention, therefore, provides a method to narrow the width of slots placed in the wall of helically slotted pipe by application of load.

Utility—Relating to In-Situ Expansion:

The present invention provides a method of placing slots in such slotted liners to enable significant diametral expansion or retraction, in combination with changes of slot width, under application of axial and torsional loads, separately or in combination. The ability to expand slotted liners in-situ finds utility in applications where a larger in-situ diameter is desired than installation restrictions allow. The ability to retract slotted liners improves the ability to remove liners in applications where contact with the borehole would otherwise significantly resist movement. The ability to change slot width, subsequent to cutting slots in pipe, is a useful adjunct to manufacturing methods, particularly where small slot widths are required and to enable change of slot width downhole to support in-situ control of slotted liner filtering characteristics.

Figure 4:
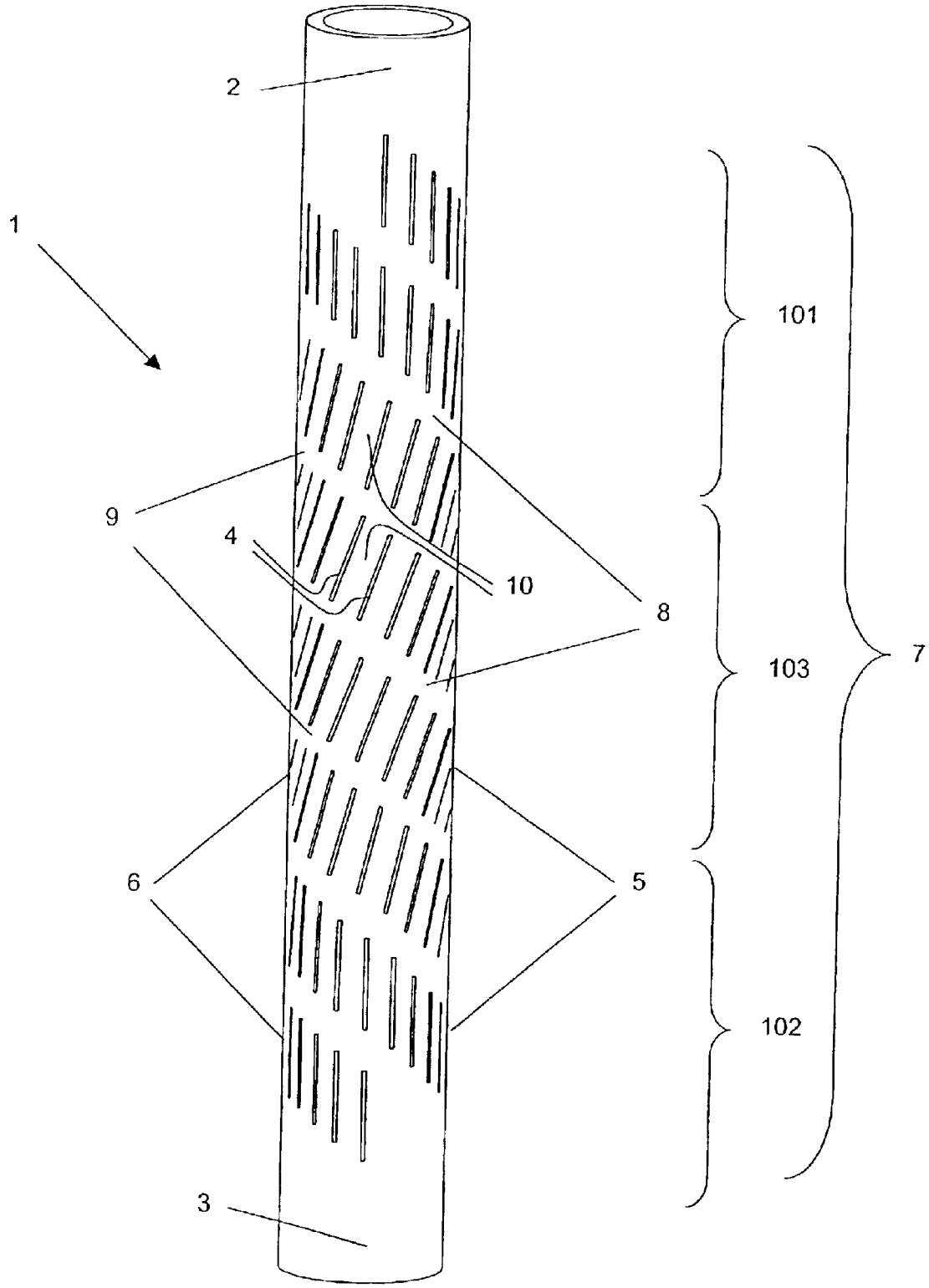
FIG. 4 is a side elevation view of a slotted liner fabricated according to the teachings of the present invention with non-longitudinal slots.
Figure 5:
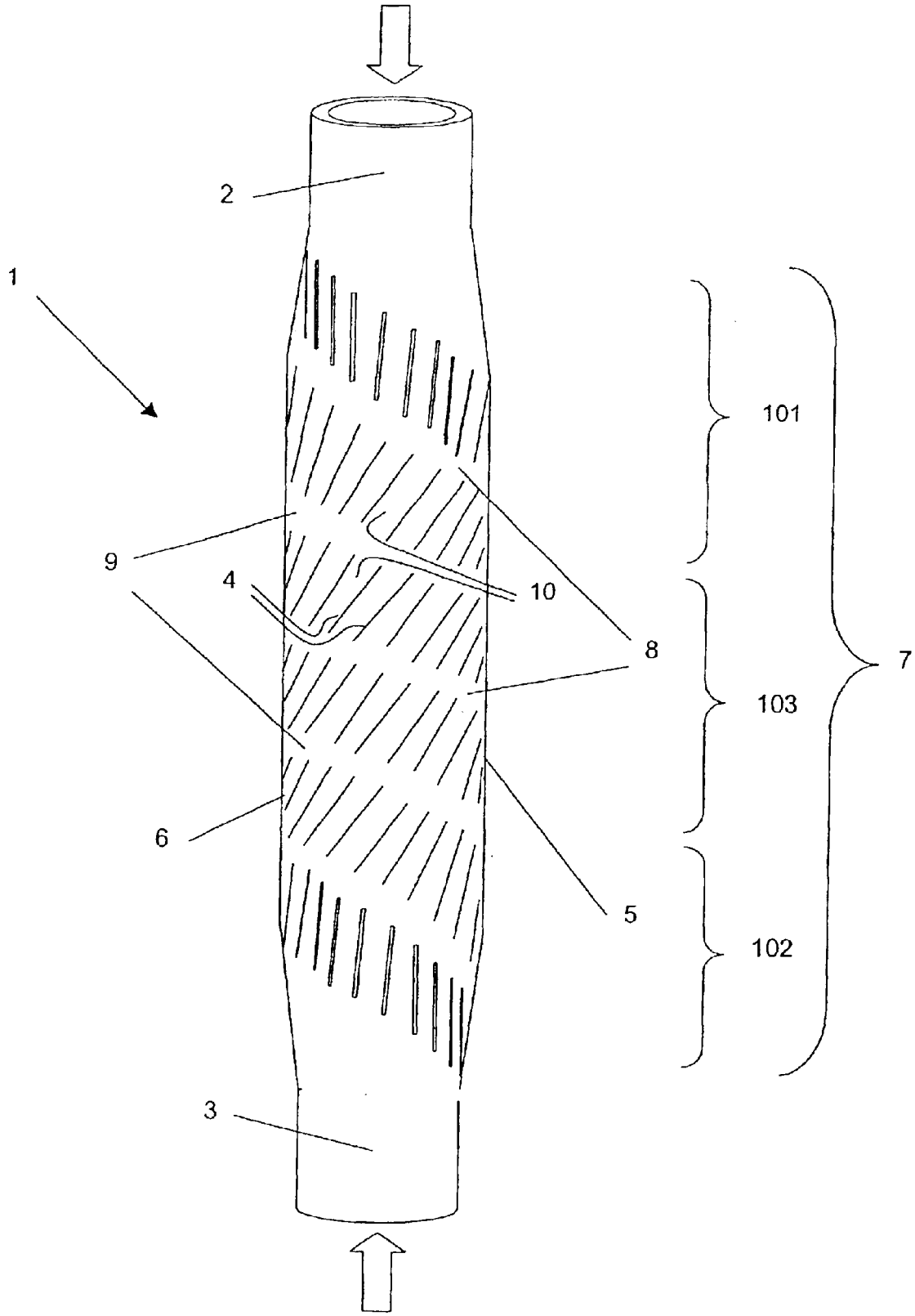
FIG. 5 is a side elevation view of the slotted liner illustrated in FIG. 4, to which an axially compressive load has been applied causing twist sufficient to close slots and reduce diameter in accordance with the teachings of the present invention. (deformations shown exaggerated).

Referring now to FIG. 4 to illustrate these relationships, it will be apparent to one skilled in the art that variation of the angle of struts 10, from longitudinal, will significantly affect the load and deformation response. The strut angle need not be constant along the tube length, but may as shown in FIG. 4 be arranged with angle beginning longitudinal at ends 2 and 3, and increasing through intervals 101 and 102 toward the mid-interval 103 over which the angle is kept constant. If the angle of struts 10 in this mid-interval 103 is chosen nearly orthogonal to the helix angle, application of axial compression will tend to expand the tubular diameter, as shown in FIG. 5, and with sufficient deformation, close the slots 4; application of tension will tend to reduce the diameter but also tend to close the slots. Referring to FIG. 5, the purpose of increasing the strut angle through the end intervals 101 and 102 is illustrated by the greater deformation shown in the mid-interval 103 so that the end intervals 101 and 102 provide a smoother transition in geometry, reducing the severity of end effects where the coils and struts join the cylindrical ends 2 and 3.

The ability to increase the diameter of helically slotted liner finds utility in industry applications where expandable sand screen (ESS) liners are desirable. These applications require liners capable of installation through up hole intervals of smaller diameter than the final in-situ expanded diameter, which expanded diameter provides benefits deriving from reduced flow loss inside the liner and improved support of the borehole mitigating collapse forces.

Figure 6:
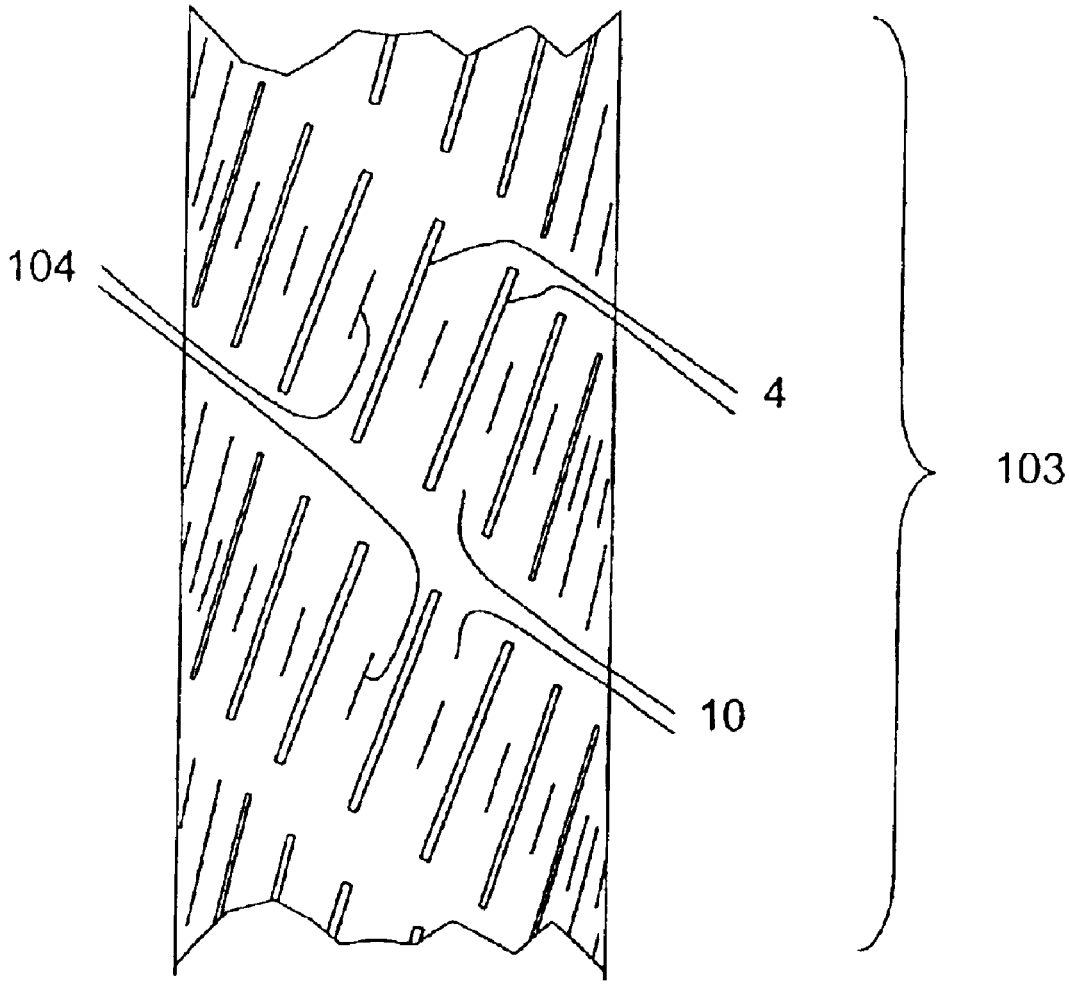
FIG. 6 is a partial side elevation view of the slotted liner illustrated in FIG. 4, showing sand exclusion slits added to the struts.

It will be evident that according to the teachings of the present invention, helical slotted liner configured to expand upon application of axial compressive load, as disclosed above, can be made to provide these benefits. Referring now to FIG. 6, it may be beneficial for such an application to provide the struts 10 having additional through wall openings or slits 104, smaller than the slots 4 and not substantially affected by the expansion deformations to provide controlled openings for filtering, subsequent to such expansion. The present invention is thus intended to also provide a helical slotted tubular article that may be expanded upon application of load.

Example of Liner Designed for Retrieval Applications.

It will be apparent to one skilled in the art, that selection of the various dimensional parameters defining the slot pattern of the helically slotted tubular article, allows for a large amount of adjustment in performance parameters. The following example illustrates one relationship obtained between slotting parameters and retraction performance.

In one arrangement of the preferred embodiment, a sample was prepared having 1.9 inch long, 0.020 inch wide slots placed through the wall of a 3.5" outside diameter by 2.992 inside diameter API grade L80 steel pipe at 12° increments on 6 inch pitch helical paths over a 60 inch interval. This sample was placed in a load frame capable of applying combined tension and torsional loads. A tension of 5,000 lb was applied while torque was increased. It was found that a torque of approximately 2000 ftlb was required to initiate significant plastic deformation and 2700 ftlb was required to just close the slots and provide a diameter reduction of approximately 0.12 inches. After closure of the slots the torque was increased to 5800 ftlb without noticeable failure or collapse of the pipe section. With this torque applied the axial load was then incremented to approximately 145,000 lb again without noticeable failure or collapse of pipe section. It will be apparent to one skilled on the art that these performance parameters are of practical utility in applications requiring removal of such a slotted liner from well bores.

This and many other similarly useful helically slotted tubular articles may be provided by following the teachings of the present invention.

What is claimed is:

1. A slotting geometry for a metal pipe having a tubular body having a first end, a second end, and a peripheral sidewall having slots arranged in a geometric pattern, the slots extending through the peripheral sidewall thereby permitting fluid communication from an exterior surface of the tubular body to an interior of the tubular body, the slotting geometry comprising:

at least one integral substantially continuous unslotted helical coil extending around the peripheral sidewall for substantially the entire axial length of the tubular body;

inter-coil helical regions between adjacent coil edges traversed by slots having a longitudinal orientation arranged to create elongate struts joining the adjacent coil edges, said elongate struts being formed by material between adjacent slots, wherein the longitudinal orientation of the slots does not align with the helical direction of said at least one coil, and wherein the elongate struts are adapted to permit the slots to be selectively opened or closed, the helical diameter to be varied, or the axial length to be changed; and both the first end and the second end of the tubular body having unslotted connecting portions, thereby facilitating connection with the tubular body.

2. The slotting geometry as defined in claim 1, wherein the peripheral sidewall has two or more unslotted helical coils of similar pitch.

3. The slotting geometry as defined in claim 2, wherein the two or more unslotted helical coils are of the same length.

4. The slotting geometry as defined in claim 2, wherein each of the two or more unslotted helical coils have a first end positioned on a first common plane transverse to a longitudinal axis of the tubular body and a second end positioned on a second common plane transverse to the longitudinal axis of the tubular body.

5. The slotting geometry as defined in claim 2, wherein the helical coils are distributed circumferentially on a plane transverse to the longitudinal axis of the tubular body.

6. The slotting geometry as defined in claim 1, wherein the slots are of substantially equal length.

7. The slotting geometry as defined in claim 1, wherein the slots are of substantially uniform width.

8. The slotting geometry as defined in claim 1, wherein the slots are evenly spaced circumferentially around the tubular body.

9. The slotting geometry as defined in claim 1, wherein the slots and the struts are all oriented longitudinally along the tubular body.

10. The slotting geometry as defined in claim 1, wherein the slots and the struts are oriented at an angle to the longitudinal axis of the tubular body.

11. The slotting geometry as defined in claim 1, wherein the at least one helical coil has a pitch that varies along its length.

12. The slotting geometry as defined in claim 1, wherein the at least one helical coil has a cross sectional area that varies along its length.

13. A slotted liner, comprising:

a metal tubular body having a first end, a second end, and a peripheral sidewall having slots arranged in a geometric pattern, the slots extending through the peripheral sidewall thereby permitting fluid communication from an exterior surface of the tubular body to an interior of the tubular body;

at least one integral substantially continuous unslotted helical coil extending around the peripheral sidewall for substantially the entire axial length of the tubular body;

inter-coil helical regions between adjacent coil edges traversed by slots having a longitudinal orientation arranged to create elongate struts joining the adjacent coil edges, said elongate struts being formed by material between adjacent slots, wherein the longitudinal orientation of the slots does not align with the helical direction of said at least one coil, and wherein the elongate struts are adapted to permit the slots to be selectively opened or closed, the helical diameter to be varied, or the axial length to be changed; and both the first end and the second end of the tubular body having unslotted connecting portions, thereby facilitating connection with the tubular body.

14. The slotted liner as defined in claim 13, wherein the peripheral sidewall has two or more unslotted helical coils of similar pitch.

15. The slotted liner as defined in claim 14, wherein the two or more unslotted helical coils are of the same length.

16. The slotted liner as defined in claim 14, wherein each of the two or more unslotted helical coils have a first end positioned on a first common plane transverse to a longitudinal axis of the tubular body and a second end positioned on a second common plane transverse to the longitudinal axis of the tubular body.

17. The slotted liner as defined in claim 14, wherein the helical coils are distributed circumferentially on a plane transverse to the longitudinal axis of the tubular body.

18. The slotted liner as defined in claim 13, wherein the slots are of substantially equal length.

19. The slotted liner as defined in claim 13, wherein the slots are of substantially uniform width.

20. The slotted liner as defined in claim 13, wherein the slots are evenly spaced circumferentially around the tubular body.

21. The slotted line as defined in claim 13, wherein the slots and the struts are all oriented longitudinally along the tubular body.

22. The slotted liner as defined in claim 13, wherein the slots and the struts are oriented at an angle to the longitudinal axis of the tubular body.

23. The slotted liner as defined in claim 13, wherein the at least one helical coil has a pitch that varies along its length.

24. The slotted liner as defined in claim 13, wherein the at least one helical coil has a cross sectional area that varies along its length.

25. The slotted liner as defined in claim 13, wherein the unslotted connecting portions of the tubular body have a reduced outer diameter.

26. A method of removing a slotted liner from a bore hole, comprising the steps of:

providing a slotted liner having a metal tubular body having a peripheral sidewall with slots arranged in a geometric pattern, the slots extending through the peripheral sidewall thereby permitting fluid communication from an exterior surface of the tubular body to an interior of the tubular body, at least one integral substantially continuous unslotted helical coil extending around the peripheral sidewall for substantially the entire length of the tubular body and inter-coil helical regions between said coils traversed by slots arranged to create elongate struts joining the edges of adjacent coils, said elongate struts being formed by material between adjacent slots;

positioning the slotted liner in the borehole; and exerting a force, upon the metal tubular body along the at least one unslotted helical coil of the metal tubular body until the slots collapse and an outer diameter dimension of the tubular body is reduced sufficiently to permit withdrawal of the slotted liner from the bore hole.

27. The method as defined in claim 26, the slots being oriented axially along the peripheral sidewall of the tubular body and the force exerted being a substantially torsional force.

28. The method as defined in claim 26, the slots being oriented in a helical pattern along the peripheral sidewall of the tubular body and the force exerted being a substantially axial force.

29. A method of expanding a slotted liner in a bore hole, comprising die steps of:

providing a slotted liner having a metal tubular body having a peripheral sidewall with slots arranged in a geometric pattern, the slots extending through the peripheral sidewall thereby permitting fluid communication from an exterior surface of the tubular body to an interior of the tubular body, at least one integral substantially continuous unslotted helical coil extending around the peripheral sidewall for substantially the entire axial length of the tubular body and inter-coil helical regions between adjacent coil edges traversed by slots having a longitudinal orientation arranged to create elongate struts joining the adjacent coil edges, said elongate struts being formed by material between adjacent slots, wherein the longitudinal orientation of the slots does not align with the helical direction of said at least one coil, and wherein the elongate struts are adapted to permit the slots to be selectively opened or closed, the helical diameter to be varied, or the axial length to be changed;

positioning the slotted liner in the borehole; and exerting a force upon the metal tubular body along the at least one unslotted helical coil of the metal tubular body until the outer diameter dimension of the tubular body increases.

30. The method as defined in claim 29, the slots being oriented axially along the peripheral sidewall of the tubular body and the force exerted being a substantially torsional force.

31. The method as defined in claim 29, the slots being oriented in a helical pattern along the peripheral sidewall of the tubular body and the force exerted being a substantially axial force.

32. A method of in situ adjustment of slot width of a slotted liner in a bore hole, comprising the steps of:

providing a slotted liner having a metal tubular body having a peripheral sidewall with slots arranged in a geometric pattern, the slots extending through the peripheral sidewall thereby permitting fluid communication from an exterior surface of the tubular body to an interior of the tubular body, at least one integral substantially continuous unslotted helical coil extending around the peripheral sidewall for substantially the entire axial length of the tubular body and inter-coil helical regions between adjacent coil edges traversed by slots having a longitudinal orientation arranged to create elongate struts joining the adjacent coil edges, said elongate struts being formed by material between adjacent slots, wherein the longitudinal orientation of the slots does not align with the helical direction of said at least one coil, and wherein the elongate struts are adapted to permit the slots to be selectively opened or closed, the helical diameter to be varied, or the axial length to be changed;

positioning the slotted liner in the borehole; and exerting a force upon the metal tubular body along the unslotted helical coil of the metal tubular body until one of a decrease in slot width or an increase in slot width is effected.

33. The method as defined in claim 32, the slots being oriented substantially axially along the peripheral sidewall of the tubular body and the force exerted being a substantially torsional force, a force exerted in a first rotational direction serving to decrease slot width and a force exerted in a second rotational direction serving to increase slot width.

34. The method as defined in claim 32, the slots being oriented in a helical pattern along the peripheral sidewall of the tubular body and the force exerted being a substantially axial force, an axial force that places the tubular body in compression serving to increase slot width and an axial force that places the tubular body in tension serving to decrease slot width.

35. A method of on surface adjustment of slot width of a slotted liner, comprising the steps of:

providing a slotted liner having a metal tubular body having a peripheral sidewall with slots arranged in a geometric pattern, the slots extending through the peripheral sidewall thereby permitting fluid communication from an exterior surface of the tubular body to an interior of the tubular body, at least one integral substantially continuous unslotted helical coil extending around the peripheral sidewall for substantially the entire length of the tubular body and inter-coil helical regions between said coils traversed by slots arranged to create elongate struts joining the edges of adjacent coils, said elongate struts being formed by material between adjacent slots; and exerting a force upon the metal tubular body along the unslotted helical coil of the metal tubular body until one of a decrease in slot width or an increase in slot width is effected.

36. The method as defined in claim 35, the slots being oriented substantially axially along the peripheral sidewall of the tubular body and the force exerted being a substantially torsional force, a force exerted in a first rotational direction serving to decrease slot width and a force exerted in a second rotational direction serving to increase slot width.

37. The method as defined in claim 35, the slots being oriented in a helical pattern along the peripheral sidewall of the tubular body and the force exerted being a substantially axial force, an axial force that places the tubular body in compression serving to increase slot width and an axial force that places the tubular body in tension serving to decrease slot width.

* * * * *

UNITED STATES PATENT AND TRADEMARK OFFICE

CERTIFICATE OF CORRECTION

PATENT NO. : 6,904,974 B2
DATED : June 14, 2005
INVENTOR(S) : M.W. Slack

It is certified that error appears in the above-identified patent and that said Letters Patent is hereby corrected as shown below:

Title page,
Item [57], ABSTRACT,
Line 4, "sustantially" should read -- substantially --.
Line 13, "iinto" should read -- into --.
Line 15, "sider" should read -- wider --.
Line 15, "narrower," should read -- narrower; --.

Column 10,
Line 53, "borehole; and" should read -- bore hole; and --.
Line 54, "force, upon" should read -- force upon --.

Column 11,
Line 2, "die" should read -- the --.
Line 22, "borehole; and" should read -- bore hole; and --.

Signed and Sealed this

Eighteenth Day of April, 2006

JON W. DUDAS
*Director of the United States Patent and Trademark Office*